United States Patent [19]

Brzezinski

[11] Patent Number: 4,748,441

[45] Date of Patent: May 31, 1988

[54] MULTIPLE FUNCTION CONTROL MEMBER

[76] Inventor: Stephen R. M. Brzezinski, 1508 W. Dunham St., South Bend, Ind. 46619

[21] Appl. No.: 908,292

[22] Filed: Sep. 17, 1986

[51] Int. Cl.[4] ..... G09G 1/00

[52] U.S. Cl. ..... 340/709; 340/706; 74/471 X; 273/148 B; 200/6 A

[58] Field of Search ..... 340/706, 709; 74/471 XY, 523; 200/6 A, DIG. 2; 273/148 B, DIG. 28; 364/190

[56] References Cited

U.S. PATENT DOCUMENTS 4,040,647 8/1977 F'Geppert ..... 200/6 A 4,491,325 1/1985 Bersheim ..... 74/471 XY 4,558,609 12/1985 Kim ..... 74/471 XY

*Primary Examiner*—Gerald L. Brigance

*Assistant Examiner*—Jeffery A. Brier

*Attorney, Agent, or Firm*—Thomas J. Dodd

[57] ABSTRACT

A control member which includes two or more pivoting ball members, one seated in a housing, and the others pivotally seated within an operational control stick integral with the first ball member. Each ball member includes a plurality of contacts with leads which extend to various operational controls. Upon touching of the ball contacts with an electrical source, current is transmitted to the operational controls to perform various operations.

2 Claims, 2 Drawing Sheets

MULTIPLE FUNCTION CONTROL MEMBER

SUMMARY OF THE INVENTION

This invention relates to control members and will have special application to hand held multiple function controls.

Hand operated controls have many useful applications, namely in aircraft, certain land vehicles, computers, and video games. The common term for such controls is a "joystick."

In a typical joystick, a single ball member has multiple contacts, which are adapted to engage other contacts which complete an electric circuit between a power source and an operational control. By hand manipulation of the joystick attached to the ball, the operator selectively causes a specific ball contact to complete the circuit which in turn activates a specific operational control (i.e. left turns, right turns, reverse movement, forward movement, etc.).

The control member of this invention includes a conventional joystick which has a second control ball seated in the joystick. The second ball is electrically connected to a second operational control which may perform different functions for the object being controlled, or which may control a second object.

Accordingly, it is an object of this invention to provide for a single unit multiple function operational control member.

Another object of this invention is to provide for an operational control member which can control the operations of two or more units.

Another object of this invention is to provide for a multiple function operational control which is efficient and economical.

Other objects of this invention will become apparent upon a reading of the following description.

BRIEF DESCRIPTION OF THE DRAWINGS

A preferred embodiment of the invention has been depicted for illustrative purposes wherein.

DESCRIPTION OF THE PREFERRED EMBODIMENT

Figure 4:
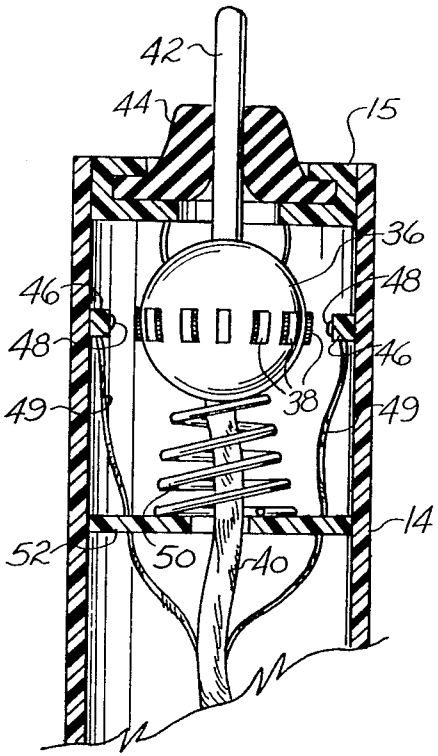
FIG. 4 is a fragmentary detail view of the second ball member as seen within broken circle 4 of FIG. 3.
Figure 2:
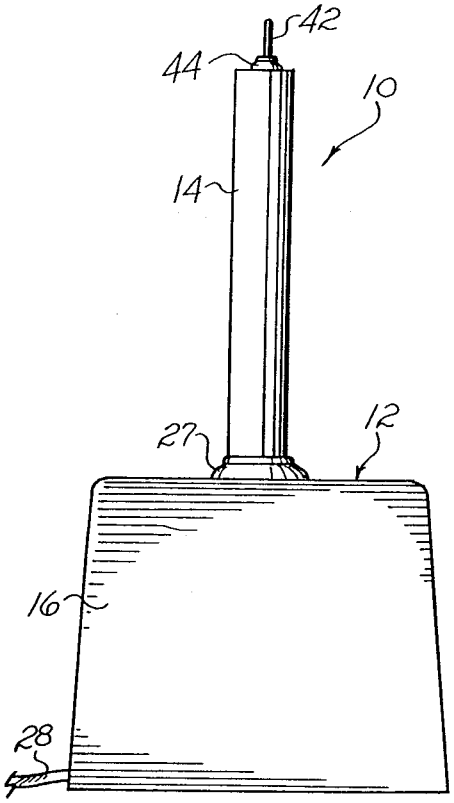
FIG. 2 is an elevational view of the operational control member.
Figure 1:
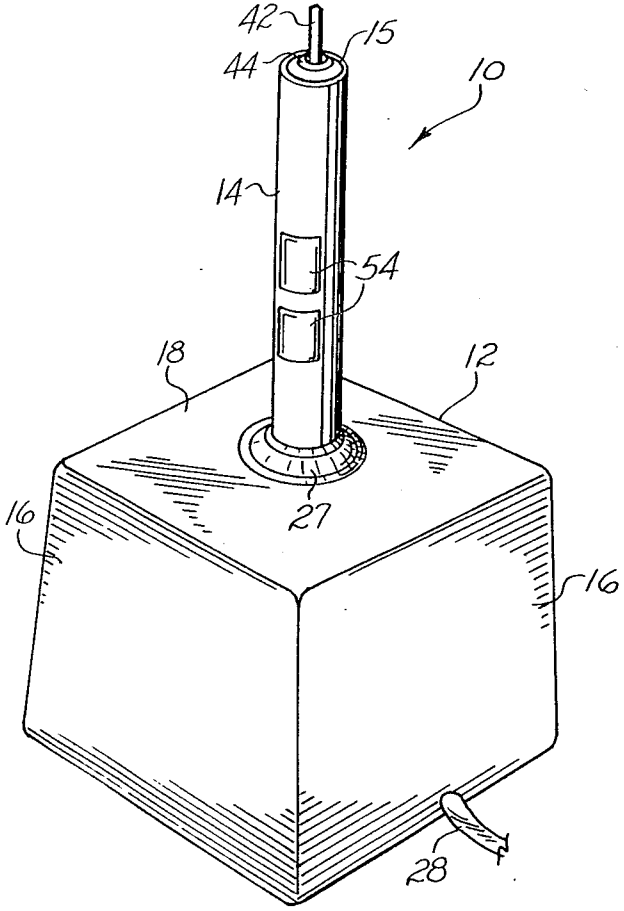
FIG. 1 is a perspective view of the operation control member.

The preferred embodiment herein described is not intended to be exhaustive or to limit the invention to the precise form disclosed. It is chosen and described to explain the principles of the invention and its application and practical use to enable others skilled in the art to utilize the invention.

Referring now to the drawings, reference numeral 10 refers generally to the multiple function control member of this invention which will be referred to by its common name, that is, a joystick. Joystick 10 includes a substantially enclosed housing 12 which carries a control stick 14. Housing 12 is formed of suitable materials such as reinforced plastic (15% ABS) and hard nylon (85%) and has side walls 16 joined to a top wall 18 which has an opening 20 through which control stick 14 extends. The bottom portion of housing 12 is covered by a plate 22 joined to housing side walls 16.

Figure 3:
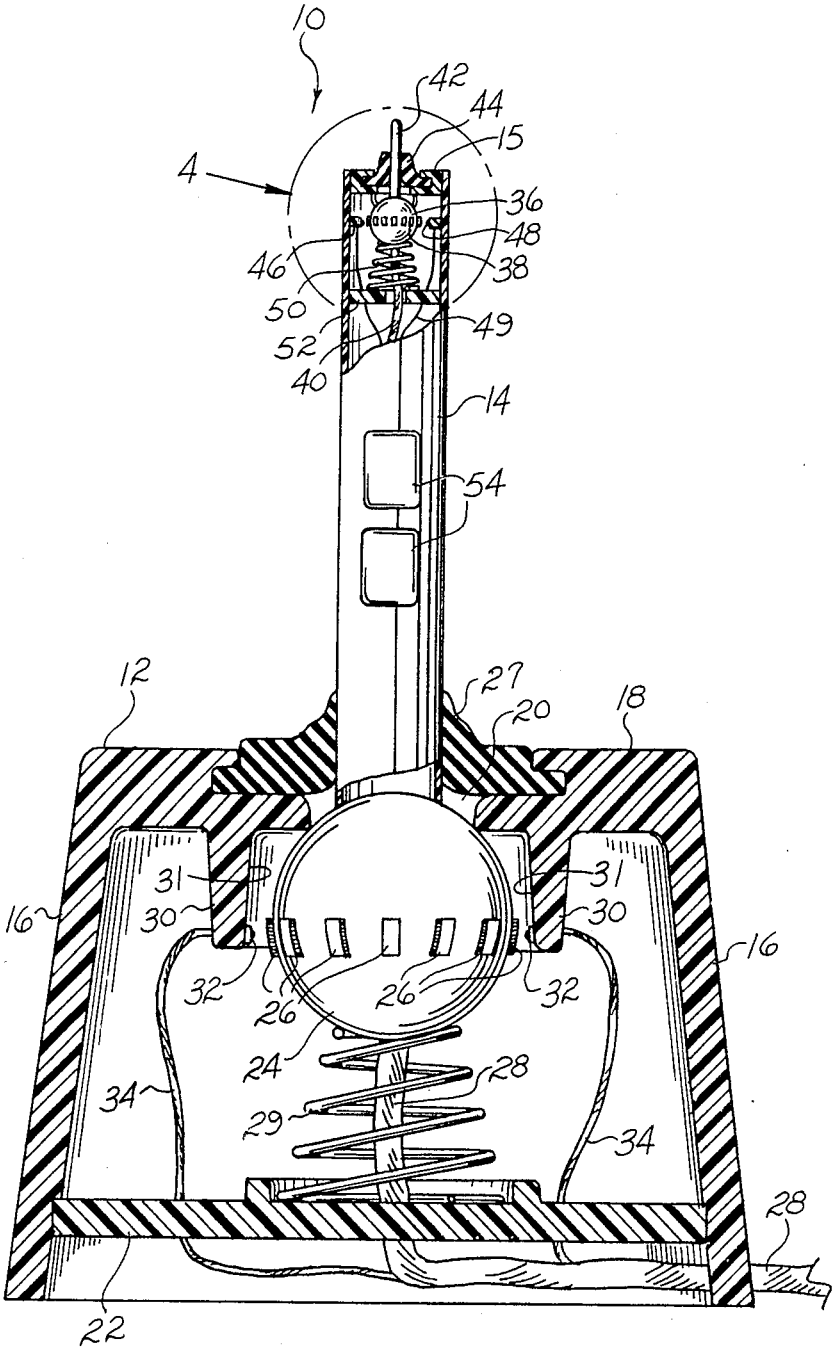
FIG. 3 is a sectional view taken along line 3—3 of FIG. 2.

Control stick 14 is of the general tubular formation shown and terminates in a lower generally spherical control ball 24 which is located in housing 12. Positioned about the equator of ball 24 are a plurality of raised contacts 26 which are electrically connected to a directional control (not shown) through leads 28. Control stick 14 is movably seated in housing 12 through a closed cell neoprene grommet 27 which is secured about housing top wall opening 20 as seen in FIG. 3. A cone-shaped helical spring 29 is seated between ball 24 and plate 22 and firmly seats the ball within housing 12. Housing 12 also includes a downturned annulus 30 which extends from housing top wall 18. A continuous conductive plate 32 is affixed to the inner wall 31 of annulus 30 and is connected by leads 34 to a power source (not shown).

Control stick 14 also includes an upper portion which houses a generally spherical second control ball 36. Positioned about the equatorial axis of ball 36 are a plurality of contacts 38 which are electrically connected to a directional control (not shown) by leads 40. Ball 36 includes an integral control stick 42 which extends through the top wall 15 of control stick 14 and is movably seated by grommet 44. An annulus 46 includes a continuous conductive plate 48 and is integrally formed in control stick 14. Leads 49 electrically connect plate 48 with a power source (not shown). A helical spring 50 is seated between ball 36 and an internal plate 52 of control stick 14. One or more buttons 54 may be secured to control stick 14 and upon depression activate certain other functions of the object (such as firing weapons, braking, etc.). Buttons 54 are conventional in nature.

Joystick 10 may be used as follows. Leads 28 are connected to a directional control member such as a computer video game controller, or the controls of an airplane or other vehicle. As one of contacts 26 of ball 24 touches conductive plate 32 due to manipulation of control stick 14 an electrical circuit is completed between the power source and the directional control. Since each of the several contacts 26 is connected to a different portion of the directional control through its corresponding lead, a different function will be performed when the different contacts are so used. For example, if the contacts 26 are connected to a direction control, the object to be manipulated will turn in various directions depending on which contact is currently in use. Control stick 42 attached to ball 36 is used in much the same manner and may be used to manipulate a second object on a computer screen the same way a first object is manipulated by the control stick 14. Alternatively, ball leads 40 may control other discreet functions of the first object.

It is understood that the invention is not limited to the details above-given, but may be modified within the scope of the following claims.

I claim:

1. A multiple function control member comprising a housing, said housing including an internal annulus having a bore therethrough defined by peripheral edge, first contacts positioned about said bore peripheral edge, a first control stick including an integral first ball member seated in said annulus, said first ball member including second contacts corresponding with said first contacts to complete an electric circuit upon touching of said first and second contacts, said first control stick also including an internal annulus spaced above said first ball member having a bore there-through defined by peripheral edges, third contacts positioned about said control stick annulus peripheral edge, a second ball member seated in said control stick annulus and including fourth contacts thereon corresponding with said third contacts to complete an electric circuit upon touching of said third and fourth contacts, outwardly accessible joystick means connected to said second ball member for controlling movement of said second ball member, a first series of leads extending from one of said first and second contacts to a first operational control wherein touching of said first and second contacts activates said first operational control, and a second series of leads extending from one of said third and fourth contacts to a second operational control wherein touching of said third and fourth contacts activates said second operational control whereby said first control stick and said joystick means are operable simultaneously and independently of each other to allow said first and second operational controls to function simultaneously and independently.

2. The multiple function control member of claim 1 and a switch located in said first control stick, outwardly accessible means for opening and closing said switch, a lead extending from said switch to a third operational control wherein closing said switch activates said third operational control.

* * * * *